US012435455B2

(12) United States Patent
Mikkelsen

(10) Patent No.: US 12,435,455 B2
(45) Date of Patent: Oct. 7, 2025

(54) AUTOMATED SEWING SYSTEM

(71) Applicant: Mikkelsen Innovation ApS, Knebel (DK)

(72) Inventor: Steen B. Mikkelsen, Knebel (DK)

(73) Assignee: Mikkelsen Innovation ApS, Knebel (DK)

( * ) Notice: Subject to any disclaimer, the term of this patent is extended or adjusted under 35 U.S.C. 154(b) by 0 days.

(21) Appl. No.: 18/565,982

(22) PCT Filed: May 30, 2022

(86) PCT No.: PCT/EP2022/064663
§ 371 (c)(1),
(2) Date: Nov. 30, 2023

(87) PCT Pub. No.: WO2022/253784
PCT Pub. Date: Dec. 8, 2022

(65) Prior Publication Data

US 2024/0254670 A1 Aug. 1, 2024

(30) Foreign Application Priority Data

Jun. 3, 2021 (DK) ..... PA202100597

(51) Int. Cl.
*D05B 35/02* (2006.01)
*D05B 3/04* (2006.01)
*D05B 39/00* (2006.01)

(52) U.S. Cl.
CPC ..... *D05B 35/02* (2013.01); *D05B 3/04* (2013.01); *D05B 39/00* (2013.01)

(58) Field of Classification Search
CPC ..... D05B 35/02; D05B 3/04; D05B 39/00
See application file for complete search history.

(56) References Cited

U.S. PATENT DOCUMENTS 3,495,492 A * 2/1970 Heinz ..... B26D 7/018 83/427
3,559,524 A 2/1971 Glastra
3,797,341 A * 3/1974 Bystron ..... B26D 7/018 269/21

(Continued)

FOREIGN PATENT DOCUMENTS

CN 104452114 A 3/2015
DE 4011665 A1 10/1990

(Continued)

OTHER PUBLICATIONS

International Search Report and Written Opinion for PCT/EP2022/064663; mail date Aug. 30, 2022; 8 pages.

*Primary Examiner* — Ismael Izaguirre
(74) *Attorney, Agent, or Firm* — Rathe Lindenbaum LLP

(57) ABSTRACT

The invention relates to an automated sewing system comprising I) a sewing head or ultrasonic welding head configured a) for connecting two or more layers of fabrics, or b) for making a pattern on one or more layers of fabric; and II) a conveyor belt unit comprising i) a conveyor belt adapted for supporting one or more layers of fabric, and ii) a motor unit adapted for moving said conveyor belt; wherein said conveyor belt further comprises c) a mechanism adapted for forming a cavity in said conveyor belt, said cavity being formed below said sewing head.

19 Claims, 2 Drawing Sheets

(56) References Cited

U.S. PATENT DOCUMENTS

| | | | | | |
|---|---|---|---|---|---|
| 3,800,719 | A * | 4/1974 | Rockerath | D05B 33/00 | 112/304 |
| 3,839,973 | A * | 10/1974 | Cummins | D05B 69/28 | 112/470.12 |
| 5,018,418 | A * | 5/1991 | Nasu | B26F 3/004 | 83/451 |
| 5,181,445 | A * | 1/1993 | Cothrell | B27B 31/006 | 83/155 |
| 5,224,406 | A | 7/1993 | Nasu | | |
| 6,178,903 | B1 * | 1/2001 | Bondanza | D05B 69/24 | 112/475.08 |

FOREIGN PATENT DOCUMENTS

| | | | |
|---|---|---|---|
| EP | 2636495 | A1 | 9/2013 |
| KR | 101941790 | B1 | 4/2019 |
| WO | 0028124 | A1 | 5/2000 |

* cited by examiner

AUTOMATED SEWING SYSTEM

FIELD OF THE INVENTION

The present invention relates to the field of automated sewing systems.

BACKGROUND OF THE INVENTION

With the current state of the art within industrial sewing systems, the sewing mechanisms (typically an oscillating needle delivering a thread from the top and connecting it with a thread from below (held in a bobbin) are in fixed positions and the operator must direct the fabric accurately into and around the sewing action. This is labour intensive, requires good manual mechanical skills, and is time consuming.

There are also industrial sewing systems, where the sewing head and bobbin move X and Y across a fixed fabric surface(s), but here the fabric must be held in suspension by clamps on a frame structure or the side and end of the machine, as the fabric is not supported from below.

OBJECT OF THE INVENTION

The objective of the present invention is to provide a solution that solves at least some of the above problems.

DESCRIPTION OF THE INVENTION

With the proposed invention the sewing head and the bobbin are moving X and Y while the fabric(s) is fixed, and now with an added conveyer belt supporting the fabric(s) from below. With this method there is no need for any mechanical clamps on a frame or on the machine edges to hold the fabric in tension. The proposed system will allow the conveyer to be redirected into a cavity below the sewing head allowing ample space for the sewing action with the needle thread connecting with the bobbin thread. It will furthermore be possible to trim cut the sewing edges while the fabric is still held in the same position on the conveyor. Both the sewing action and the cutting action will be accurate and fast, as the fabric is laying still on the conveyor belt in the same fixed position during both processes. When both the sewing and cutting are completed, the conveyor belt moves the items out of the machine area, while pulling in new materials to be processed on the other end from a roll or multiple rolls.

The advantages are: 1) one, two or more layers can be sewn and cut without clamping the edges; 2) better utilization of the fabrics all the way to the edges; 3) any shape or contour can be sewn and cut; 4) multiple parts can be nested to reduce waste; 5) no need for manual labor during sewing and cutting of full rolls as there is no clamping involved; 6) sewing and cutting in the same machine takes up less space than current systems with two separate sewing and cutting tables; and 7) hand sewing creates slight differences due to the skill of the operator. Two seams may be slightly different, whereas the present invention creates a much more perfect sizing. When you try on clothing, the same "size" is actually slightly different on each item as it was sewn slightly differently.

A first aspect relates to an automated sewing system comprising:

a sewing head or ultrasonic welding head configured a) for connecting two or more layers of fabrics, or b) for making a pattern on one or more layers of fabric; and a conveyor belt unit comprising i) a conveyor belt adapted for supporting one or more layers of fabric, and ii) a motor unit adapted for moving said conveyor belt; wherein said conveyor belt further comprises c) a mechanism adapted for forming a cavity in said conveyor belt, said cavity being formed below said sewing head.

In the present context, the term "cavity" is to be understood broadly, and includes any fold made of the conveyor belt securing a re-routing of the conveyor belt away from the upper working surface of the system.

The term "conveyor belt," as used in the present disclosure, generally refers to any type of endless track or belt, typically configured to be driven by a geared mechanism or drum. The term "conveyor belt" should not be considered to be limited to any particular type of conveyor belt unless otherwise specified herein. Hence, the conveyor belt may in some embodiments comprise multiple belts of a relatively narrow width (e.g., about 1-15 cm, preferably about 2-5 cm) positioned side-by-side, e.g., with a distance between (e.g., about 1-15 cm, preferably about 2-5 cm), that together defines a single conveyor belt.

As used in the specification and the appended claims, the singular forms "a", "an", and "the" include plural referents unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about", it will be understood that the particular value forms another embodiment.

It should be noted that embodiments and features described in the context of one of the aspects of the present invention also apply to the other aspects of the invention.

The invention is described in more detail in the following detailed description of a preferred embodiment, with reference to the figures.

REFERENCES

Figure 1:
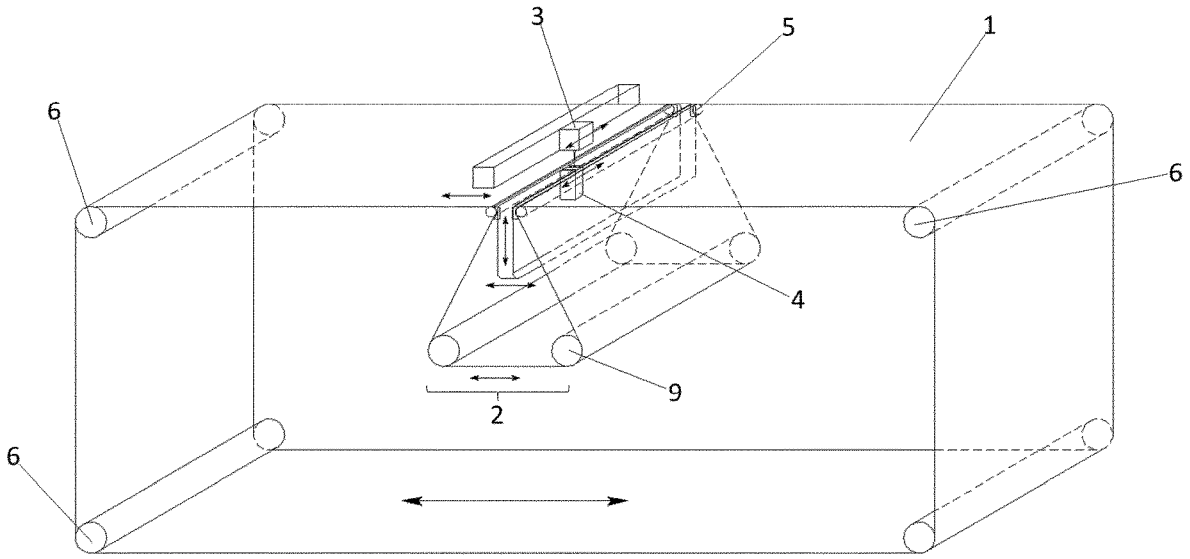
FIG. 1 is a schematic drawing of an automated sewing system in accordance with various embodiments of the invention.
Figure 2:
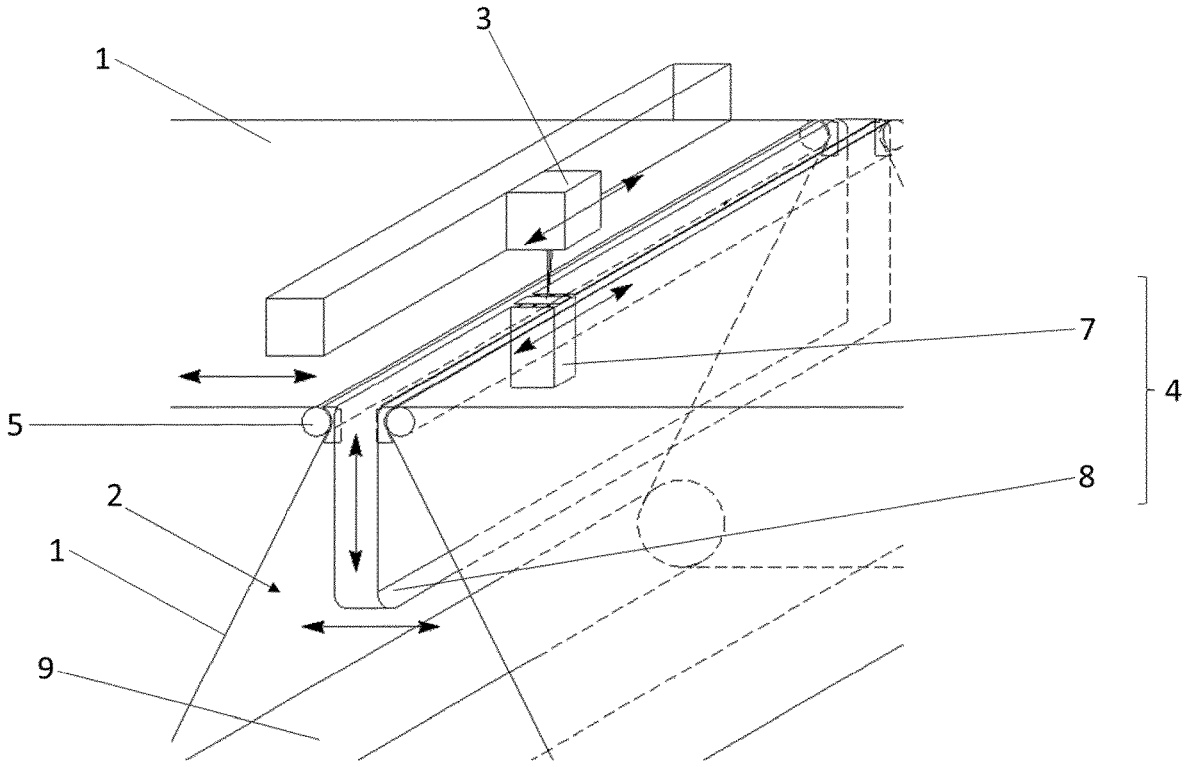
FIG. 2 is a closeup view of FIG. 1 to better show the cavity and the bobbin unit positioned therein.

1 Conveyor belt
2 Cavity
3 Sewing head
4 Bobbin unit
5 Roller or nose bar
6 Roller
7 Bobbin
8 Bobbin cage
9 Roller

DETAILED DESCRIPTION OF THE INVENTION

A first aspect relates to an automated sewing system comprising:

a sewing head or ultrasonic welding head configured a) for connecting two or more layers of fabrics, or b) for making a pattern on one or more layers of fabric; and a conveyor belt unit comprising i) a conveyor belt adapted for supporting one or more layers of fabric, and ii) a motor unit adapted for moving said conveyor belt; wherein said conveyor belt further comprises c) a mechanism adapted for forming a cavity in said conveyor belt, said cavity being formed below said sewing head.

Embodiment 1: Moving Sewing Head and Moving Bobbin in Both the X and Y Directions. Fixed Conveyer and Fabric while Sewing (FIG. 1)

In one or more embodiments, the mechanism adapted for forming a cavity in said conveyor belt comprises an upper pair of rollers or nose bars, and a lower pair of rollers, said pairs of rollers or nose bars defining said cavity.

In one or more embodiments, the sewing head is configured to move in the X- and Y-direction across said conveyor belt.

In one or more embodiments, the automated sewing system further comprises a bobbin positioned within said cavity, wherein said mechanism adapted for forming said cavity is adapted for displacing said cavity and bobbin simultaneously with the movements of said sewing head.

FIG. 1 shows a view of an automated sewing system including a moving bobbin cage.

The system comprises a conveyer belt 1 with a thickness of about 1 mm, perforated with a high friction silicone surface, and sufficiently flexible to roll around a pair of rollers 5 with diameter of about 15 mm or a rounded edge (nose bar) with a radius of about 8 mm. An example of such a belt type could be Habasit FAB-5ER 10. In this embodiment, the belt only moves (indexes) when a new full table of fabrics (in pre-cut sheet form or roll form) is loading or unloading. The conveyor belt 1 and the fabric (not shown) are thus not moving (they are fixed) during the actual sewing process. Only the sewing head 3 and bobbin unit 4 moves during sewing process. This is different from most common sewing machines, where the fabric is moving during sewing.

Four larger rollers 6 (e.g., about 60 mm in diameter) support the conveyer belt 1 running around the whole system. One of the rollers 6 is motorized to move the conveyor belt 1 forward when pulling in more fabrics to be cut (not during sewing).

The conveyer belt 1 is "re-directed" into forming a cavity 2 to pass under a bobbin unit 4 to avoid getting in conflict with the sewing operation. The fabric thereby passes over and above the bobbin, e.g., on a smooth metal surface with channels for receiving the needle. The sewing head may comprise a sewing shoe.

The bobbin unit 4 moves in X- and Y-directions below the fabric in synchronicity with the sewing head 3.

The relatively smaller rollers (or nose bars) 5 re-direct the conveyor belt 1 downwards and underneath the bobbin unit 4. The bobbin unit 4 may comprise an elongate bobbin cage 8 capable of being moved in the X-direction (i.e., along the system) and in which the bobbin 7 itself is configured to move in the Y direction (i.e., across the system). The bobbin 7 may be configured to move in the Y direction by aid of a servo motor and a belt (e.g., a steel belt) connected to the bobbin 7. A steel belt has very low friction towards the fabric, so it does not dislocate the fabric during sewing. Potentially a slight air cushion can help eliminate friction if required.

Hence, preferably, the bobbin cage 8 entailing the bobbin 7, the two smaller top rollers or nose bars 5, the two larger bottom rollers 9, the Y-direction motor and belt, and a support frame (not shown) moves in the X-direction.

The X and Y movements of the bobbin unit 4 may be servo controlled and synchronized with the sewing head 3 from above, so there is a precise connection of the needle dispensing the top thread and the bobbin 7 dispensing the bottom thread to create a lock stitch, or other types of stitches.

A servo motor may be configured to move the bobbin cage 8 in the X-direction. Alternatively, a motor may use a set brackets from a top beam (traverse) to move the bobbing cage 8 as they always move in sync in the X-direction.

The needle action and the bobbin unit action are split, so the only connection from top to bottom is where the needle meets the bobbin during the sewing oscillations (FIG. 3). This allows very wide fabrics to be sewn while laying fixed and flat on the conveyer belt and not being stretched out by multiple clamps on the sides as in prior art solutions.

One servo motor may be configured to move a beam (traverse) in the X direction above the full working surface of the system.

One servo motor may be configured to move the sewing head 3 in the Y direction across the full depth of the working surface of the system.

One servo motor may be configured to move the bobbin cage 8 in the X direction underneath the full working surface of the system. Alternatively, the mentioned top beam (traverse) is connected via two brackets on the sides (outside conveyer belt area) to the bobbin cage 8. That eliminates one servo motor and simplifies the motion system.

One servo motor may be configured to move the bobbin in the Y-direction across the full depth of the working surface of the system.

In one or more embodiments, the motor unit is adapted for solely moving said conveyor belt back and forth in the X-direction during the initial positioning of a fabric relative to said sewing head and during the unloading operation.

Advantages of embodiment 1: The setup allows the most space for the bobbin itself (larger thread) and the involved mechanics to move it in the X and Y direction. This setup allows for cutting immediately following the sewing action, while the fabric(s) is still held in its original position on the belt. A secondary tool head mounted next to the sewing head will oscillate a cutting blade through the fabric(s) into a small matching cavity below the fabric(s) right next to the bobbin cavity (both cavities may be encompassed by the same cavity). As the fabric(s) is still in its original position on the belt, the cutting will be accurately done in relation to the sewing paths.

Disadvantages of embodiment 1: An optional vacuum system (e.g., narrow hollow extrusions) below the perforated conveyer belt will have to be folded in and out (like window blinds) so they do not obstruct the movement of the bobbin cage.

Embodiment 2: Moving Sewing Head and Moving Bobbin in Y Direction Only. Conveyer Belt and Fabric Moving in X Direction while Sewing This embodiment involves all the same components as the above (exemplified by the same figures), except that the bobbin cage 8 is now fixed in the X-direction and the beam supporting the sewing head is also fixed in the X-direction. The bobbin 7 and the sewing head 3 move in synchronicity in the Y direction. In this embodiment, the conveyer belt 1 is more active and is configured to move the fabric in the X direction during the sewing operation, as well as during the loading and unloading operation of fabric.

In one or more embodiments, the sewing head is configured to move solely in the Y-direction across said conveyor belt.

In one or more embodiments, the motor unit is adapted for moving said conveyor belt back and forth in the X-direction simultaneously/synchronically with the movements and/or activation of said sewing head.

Advantages of embodiment 2: The machine area before and after the bobbin cage can be supported by a stationary vacuum table, which will support the belt (hold it up) and provide vacuum flow for holding down one or two layers of the fabric, even when belt is moving.

Disadvantages of embodiment 2: As the fabric will need to move to each end of the item being sewn, it will take up double the space (length) compared to embodiment 1, discussed above. Space is always an issue for customers.

Moving the conveyer belt back and forth while sewing might reduce accuracy due to belt elongation. It is not possible to cut the fabric after sewing.

Embodiment 3: As Embodiment 1 with Moving Sewing Head 3 and Moving Bobbin Unit 4 in Both X- and Y-Directions. The Conveyer and Fabric are Static while Sewing. Low Profile Bobbin Cage 8

In this embodiment, the bobbin cage 8 is curved at the bottom and is configured to re-route the conveyor belt 1 down below the bobbin cage 8 (like a ball rolling on piano keys). The bobbin cage 8 may be relatively shallow (low profile). Multiple, optionally hollow, columns (not shown), e.g., of extruded aluminium, may be mounted on pins and held up by springs. When the bobbin cage 8 passes over each column, the column is pushed down, e.g., by a glide shoe or linear bearing, thereby generating a cavity 2 in the conveyer belt 1. The columns may be hollow, i.e., provided with a channel, allowing vacuum, or at least a reduced pressure relative to the surroundings, to form therein, thereby creating a hold of the fabric. In this situation, the conveyer belt 1 is preferably perforated to allow the reduced pressure to work through the belt and onto the fabric. Hence, the same X- and Y-movements of the bobbin unit 4 and sewing head 3 as in Embodiment 1.

In one or more embodiments, said mechanism adapted for forming a cavity in said conveyor belt comprises a bobbin with a cage having a smoothly curved underside, and wherein said conveyor belt moves along said curved underside, thereby forming said cavity.

Advantages of embodiment 3: The vacuum system is stationarily positioned under the conveyer belt, except that each column can move down when the bobbin cage passes above it. This allows the system to do both sewing and cutting of the fabric, e.g., with a vacuum hold down system, or the like, ensuring the fabric does not get dislocated either by the sewing action or the cutting action.

In one or more embodiments, the automated sewing system further comprises a cutting head adapted for cutting into said cavity.

Disadvantages of embodiment 3: The bobbin cage should preferably be low profile, which may be impractical. That could be overcome, however, if the columns can move further down allowing more space for the bobbin cage, but it will complicate the system.

Embodiment 4: Like Embodiment 2 with Moving Sewing Head 3 and Moving Bobbin 7 in the Y-Direction Only. The Conveyer Belt 1 and Fabric are Moved in the X-Direction while Sewing This embodiment involves the same components as embodiment 3 but eliminates the need for the columns to move down. There will be a permanent curve below the bobbin cage 8 where the belt 1 passes over.

Advantages of embodiment 4: Stationary vacuum table. No moving columns. Permanent re-routing of belt below bobbin cage.

Disadvantages of embodiment 4: The bobbin cage must preferably be configured as a relative low profile as in embodiment 3, but with a very flexible conveyer belt it is less of a problem to re-route the belt sufficiently downwards to provide more space for the bobbin cage. This setup cannot do both sewing and cutting. As the fabric will need to move to each end of the item being sewn, it will take up double the space (length) compared to the above-mentioned embodiments 1 and 3. Space is always an issue for customers. Moving the conveyer belt back and forth while sewing might reduce accuracy due the belt elongation.

Embodiment 5: Like any One of the Embodiments 1-4, but with an Ultrasonic Welding Head (not Shown) Instead of a Sewing Head This embodiment may involve the same components as embodiments 1-4 but eliminates the need for a traditional bobbin. Rather the amended bobbin will preferably be provided with a metal plate on its top to secure a proper welding. Obviously, this embodiment is only suitable for fabrics/textiles that can be melt welded together.

Embodiment 6: Integrated Cutting Tool into Embodiments 1 and 3

The system may also be configured to cut the fabric after the sewing operation. A cutting tool will cut the same unmoved (undisturbed) fabric surface that has just been sewn with embodiments 1 and 3 (with moving bobbin cage). This will eliminate the need for moving the sewn fabric to a separate cutting station.

The cutting operation could be performed using a cutting tool with an oscillating blade, such as those commonly used by Esko, Zund, MCT, and others. The cutting blade may be inserted into a tangential tool head, preferably positioned next to the sewing head (or on the backside of the gantry). The cutting takes place after the sewing, and thus not simultaneously.

The cutting tool is configured such that the cutting blade, preferably an oscillating blade, penetrates the fabric and moves into the cavity next to the bobbin. The cavity may be a separate cavity formed next to the cavity for the bobbin unit.

Preferably, the cutting tool comprises a low friction glide shoe (commonly used on cutting machines from Zund, Eskos, or the like) surrounding the cutting blade to reduce the risk of the fabric moving (being pushed), while the cutting operation is taking place. The glide shoe will preferably be configured to be wider than the bobbin opening, so there is sufficient friction between the fabric and the non-moving conveyor belt to prevent any undesired movements of the fabric.

Thereby, the system can perform double duty on one working surface.

The system of the present invention may thereby have the following functions:

1) Fully automated sewing of two layers (rolls) of materials,
2) Sewing patterns can be done in any size, shape, or contour (no restrictions),
3) Precision cutting may be performed along the sewn edges right after sewing.

Benefits for the User:

1) Less waste, as fabric can be cut all the way to the edges (no clamps needed).
2) It would be possible to mix and match shapes (per order or per collection or order intake/just in time).
3) It would be possible to auto-nest different shapes=greatly reduce waste.
4) One operator can manage several machines at the same time.
5) No manual labor time wasted to attach clamps or to switch out frames holding the fabric in suspension.
6) Sewing and cutting in one machine takes up less space in the factory.

The invention claimed is:

1. An automated sewing system comprising:

a sewing head or ultrasonic welding head configured a) for connecting two or more layers of fabrics, or b) for making a pattern on one or more layers of fabric; and a conveyor belt unit comprising i) a conveyor belt adapted for supporting one or more layers of fabric, and ii) a motor unit adapted for moving said conveyor belt;

said conveyor belt further comprises c) a mechanism adapted for forming a cavity in said conveyor belt, said cavity being formed below said sewing head; and a cutting head adapted for cutting into said cavity.

2. The automated sewing system according to claim 1, wherein said mechanism adapted for forming a cavity in said conveyor belt comprises an upper pair of rollers or nose bars, and a lower pair of rollers, said pairs of rollers or nose bars defining said cavity.

3. The automated sewing system according to claim 1, wherein said mechanism adapted for forming a cavity in said conveyor belt comprises a bobbin unit with a bobbin and a bobbin cage, said bobbin cage having a smoothly curved underside, and wherein said conveyor belt moves along said curved underside, thereby forming said cavity.

4. The automated sewing system according to claim 1, wherein said sewing head is configured to move in the X- and Y-direction across said conveyor belt.

5. The automated sewing system according to claim 4, further comprising a bobbin positioned within said cavity, wherein said mechanism adapted for forming said cavity is adapted for displacing said cavity and bobbin simultaneously or synchronously with the movements of said sewing head.

6. The automated sewing system according to claim 4, wherein said motor unit is adapted for solely moving said conveyor belt back and forth in the X-direction during the initial positioning of a fabric relative to said sewing head and during the unloading operation.

7. The automated sewing system according to claim 1, wherein said sewing head is configured to move solely in the Y-direction across said conveyor belt.

8. The automated sewing system according to claim 7, wherein said motor unit is adapted for moving said conveyor belt back and forth in the X-direction simultaneously or synchronously with the movements and/or activation of said sewing head.

9. An automated sewing system comprising:

a sewing head or ultrasonic welding head configured a) for connecting two or more layers of fabrics, or b) for making a pattern on one or more layers of fabric; and a conveyor belt unit comprising i) a conveyor belt adapted for supporting one or more layers of fabric, and ii) a motor unit adapted for moving said conveyor belt;

said conveyor belt further comprises c) a mechanism adapted for forming a first cavity in said conveyor belt, said first cavity being formed below said sewing head;

a mechanism adapted for forming a second cavity in said conveyor belt, said second cavity being formed next to said first cavity; and a the cutting head adapted for cutting into said second cavity.

10. The automated sewing system according to claim 2, wherein the upper pair of rollers or nose bars are smaller than the lower pair of rollers or nose bars.

11. The automated sewing system according to claim 1, further including a second belt movable in the Y-direction, a portion of the second belt being above a cavity opening.

12. An automated sewing system comprising:

a sewing head or ultrasonic welding head configured a) for connecting two or more layers of fabrics, or b) for making a pattern on one or more layers of fabric; and a conveyor belt unit comprising i) a conveyor belt adapted for supporting one or more layers of fabric, and ii) a motor unit adapted for moving said conveyor belt;

said conveyor belt further comprises c) a mechanism adapted for forming a cavity in said conveyor belt, said cavity being formed below said sewing head;

wherein said sewing head is configured to move in the X- and Y-direction across said conveyor belt; and wherein said motor unit is adapted for solely moving said conveyor belt back and forth in the X-direction during the initial positioning of a fabric relative to said sewing head and during the unloading operation.

13. The automated sewing system of claim 12, wherein said mechanism adapted for forming a cavity in said conveyor belt comprises an upper pair of rollers or nose bars, and a lower pair of rollers, said pairs of rollers or nose bars defining said cavity, wherein the upper pair of rollers or nose bars are smaller than the lower pair of rollers or nose bars.

14. The automated sewing system according to claim 12, further including a second belt movable in the Y-direction, a portion of the second belt being above a cavity opening.

15. The automated sewing system according to claim 12, further including a cutting head adapted for cutting into said cavity.

16. An automated sewing system comprising:

a sewing head or ultrasonic welding head configured a) for connecting two or more layers of fabrics, or b) for making a pattern on one or more layers of fabric; and a conveyor belt unit comprising i) a conveyor belt adapted for supporting one or more layers of fabric, and ii) a motor unit adapted for moving said conveyor belt;

said conveyor belt further comprises c) a mechanism adapted for forming a cavity in said conveyor belt, said cavity being formed below said sewing head;

wherein said sewing head is configured to move solely in the Y-direction across said conveyor belt; and wherein said motor unit is adapted for moving said conveyor belt back and forth in the X-direction simultaneously or synchronously with the movements and/or activation of said sewing head.

17. The automated sewing system of claim 16, wherein said mechanism adapted for forming a cavity in said conveyor belt comprises an upper pair of rollers or nose bars, and a lower pair of rollers, said pairs of rollers or nose bars defining said cavity, wherein the upper pair of rollers or nose bars are smaller than the lower pair of rollers or nose bars.

18. The automated sewing system according to claim 16, further including a second belt movable in the Y-direction, a portion of the second belt being above a cavity opening.

19. The automated sewing system according to claim 16, further including a cutting head adapted for cutting into said cavity.

* * * * *